United States Patent [19]

Baugh et al.

[11] 4,244,330

[45] Jan. 13, 1981

[54] ENGINE CYLINDER LINER HAVING A MID STOP

[75] Inventors: James D. Baugh, Greensburgh; Terrence M. Shaw, Columbus; Roy J. Primus, Columbus; Richard E. Glasson, Columbus, all of Ind.

[73] Assignee: Cummins Engine Company, Inc., Columbus, Ind.

[21] Appl. No.: 959,702

[22] Filed: Nov. 13, 1978

[51] Int. Cl.[3] ..... F02F 1/16

[52] U.S. Cl. ..... 123/41.84; 123/193 C

[58] Field of Search ..... 123/41.84, 41.83, 41.81, 123/41.71, 193 C, 193 CH

[56] References Cited

U.S. PATENT DOCUMENTS

| | | | |
|---|---|---|---|
| 1,396,890 | 11/1921 | Short | 123/41.83 |
| 1,643,645 | 9/1927 | Strand | 123/41.84 |
| 2,405,847 | 8/1946 | Pullin | 123/41.81 |
| 2,783,749 | 3/1957 | Effmann | 123/41.83 |
| 3,315,573 | 4/1967 | Castelet | 92/171 |
| 3,403,661 | 10/1968 | Valentine et al. | 123/41.84 |
| 3,628,427 | 12/1971 | Bailey | 92/144 |
| 3,853,099 | 12/1974 | Feather et al. | 123/41.84 |
| 3,882,842 | 5/1975 | Bailey et al. | 123/193 C |
| 4,131,093 | 12/1978 | Mansfield | 123/41.85 |
| 4,147,140 | 4/1979 | Mansfield | 123/41.85 |

FOREIGN PATENT DOCUMENTS

| | | |
|---|---|---|
| 2140378 | 2/1973 | Fed. Rep. of Germany . |
| 1043913 | 11/1953 | France . |
| 1116882 | 5/1956 | France . |
| 491545 | 9/1938 | United Kingdom . |
| 522730 | 6/1940 | United Kingdom . |
| 615045 | 12/1948 | United Kingdom . |
| 1215111 | 12/1970 | United Kingdom . |
| 1244800 | 9/1971 | United Kingdom . |
| 1449473 | 9/1976 | United Kingdom . |
| 1479139 | 7/1977 | United Kingdom . |

*Primary Examiner*—Craig R. Feinberg

*Attorney, Agent, or Firm*—Sixbey, Friedman & Leedom

[57] ABSTRACT

A cylinder liner is disclosed for an internal combustion engine including a cylindrical hollow body having a press fitted upper end and a stop located intermediate the liner ends for engaging an engine block liner stop to provide upper and lower seals for a coolant passage. The outside surfaces of the liner adjacent the press fitted upper end and the stop are formed to permit a settable plastic material to be used between the liner and engine block to assist in forming the coolant seal and to provide radial support to the liner to permit the lower 30 percent of the cylinder liner to be free of any direct contact with the engine block. This design also permits use of a smaller capacity cooling system and improves lubricating oil flow within the engine block.

10 Claims, 8 Drawing Figures

ENGINE CYLINDER LINER HAVING A MID STOP

BAKCGROUND OF THE INVENTION

1. Field of the Invention

This invention relates to the field of replaceable liners for the cylinders of internal combustion engines.

2. Prior Art

The incorporation of replaceable cylinder liners in the design of an internal combustion engine provides numerous advantages to the manufacturer and user of such an engine in addition to the obvious benefit of allowing such liners to be replaced during overhaul of the engine. For example, cylinder liners eliminate the necessity to scrap an entire engine block during manufacture should the inside surface of one cylinder be improperly machined. Despite this and other advantages, numerous problems attend the use of replaceable cylinder liners as is exemplified by the great variety of liner designs previously used by engine manufacturers. While each of the previously known liner designs have demonstrable advantages, no single design appears to be optimal.

For example, U.S. Pat. No. 3,403,661 discloses a liner design for use in an engine block having a counterbored cylinder cavity wherein the liner includes a radially outwardly extending flange designed to be seated in the counterbore so that the liner may be easily clamped into place by the engine cylinder head. In order to provide for coolant flow around the liner, a seal is formed between the engine block and a lower portion of the liner spaced from the top flange. Due to vibration and thermally induced size changes of the liner, relative motion occurs in the seal area of a type which would destroy conventionally known seals. This is particularly true since coolant passages are normally formed in a manner to cause particles within the coolant to collect in the seal area and eventually work between the sealed surfaces resulting in hastened seal destruction. To deal with this problem, a relatively complicated three part seal is disclosed for use with the liner disclosed by U.S. Pat. No. 3,403,661 resulting in a substantial increase in manufacturing costs. One possibility for solving the coolant seal problem would be to move the block engaging flange of the liner to the lowest point in the coolant passage such as illustrated in U.S. Pat. No. 3,315,573 to Castelet. This approach, however, leads to head gasket seal problems due to unequal thermal expansion of the block and liner. While such top seal leaks may be solved in part by the provision of a composite liner having a thermal expansion coefficient more nearly equal to that of the engine block, the provision of a composite structure measurably increases manufacturing costs and is, thus, not an optimum design. Some manufacturers have resorted to complicated compliant or even resilient seals to accommodate size changes due to thermal expansion such as illustrated in U.S. Pat. Nos. 3,628,427 and 3,882,842. The liner designs illustrated in these patents present additional problems by virtue of the provision of an upper liner portion which is out of direct radial contact with the engine block. This arrangement increases the possibility of undesirable relative movement between the liner and the engine head which could result in head gasket failure or in the need for liner wall thickening which adds to cost and decreases thermal conduction through the liner. Other types of liner designs having stop flanges located intermediate the ends of the liner are disclosed in German Pat. No. 2,140,378, French Pat. Nos. 1,043,913 and 1,116,882 and British Pat. No. 615,045 but none of these patents discloses an optimum design from the standpoint of low cost and long seal life integrity.

SUMMARY OF THE INVENTION

The primary object of this invention is to overcome the deficiencies of the prior art as discussed above. In particular, the subject invention provides a cylinder design of great simplicity without sacrificing the functional advantages which heretofore has required more complex and costly designs.

A more particular object is to provide a cylinder liner which forms a combustion gas seal and a coolant seal having superior characteristics without increasing the complexity or cost over liner designs known heretofore.

Still another object of this invention is to provide a cylinder liner which is capable of withstanding very high combustion gas pressure without substantial deformation and which is at the same time relatively easy to assemble within an engine block designed to receive the liner.

Yet another object of this invention is to provide a cylinder liner including a stop positioned intermediate the ends of the liner wherein the outer surface of the liner immediately below the stop is formed to permit a settable plastic material to be inserted between the liner and the engine block to improve the coolant seal and to provide radial support to the liner while permitting easy installation and removal of the liner.

A more specific object of this invention is to provide a cylinder liner including an outer end having a pair of annular surfaces for engaging the cylinder cavity in a press fit wherein the annular surfaces are separated by an circular recess for retaining settable plastic material capable of hardening after assembly to enhance the coolant seal provided by the press fit and to enhance radial support of the liner at the point subjected to the highest combustion gas pressures.

Yet another object of this invention is to provide a cylinder liner having an inner portion extending over at least 30 percent of the innermost axial length of the liner which is free of all direct contact with the engine block to permit use of a smaller capacity cooling system and to improve lubrication oil flow within the engine.

The above objects are achieved by a cylinder liner including a hollow cylindrical body having an outer end boss provided with a pair of axially spaced annular surfaces for engaging compressively and frictionally the corresponding inside surfaces of the cylinder cavity in which liner is placed wherein the annular surfaces are separated by a circular recess for retaining settable plastic material. A stop boss is formed intermediate the ends of the cylindrical body to create a lip for engaging a liner stop within the engine block thereby forming a coolant passage seal with the engine block in a manner which minimizes distortion of the inside piston engaging surface of the liner.

Other and more specific objects of the invention will become apparent from a consideration of the drawings and the following description of the preferred embodiment.

DETAILED DESCRIPTION OF THE PREFERRED EMBODIMENTS

Figure 1:
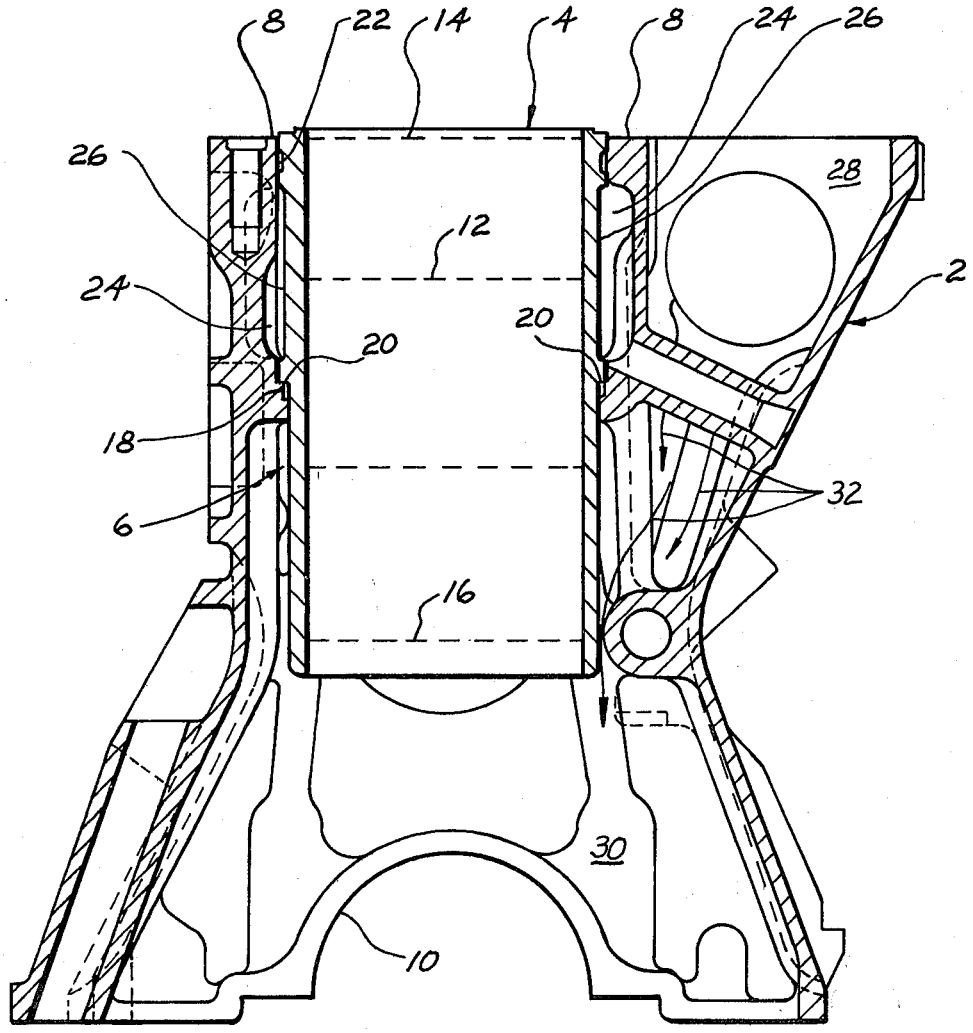
FIG. 1 is a cross sectional view of an internal combustion engine block including a cylinder liner constructed in accordance with the subject invention.

The subject invention is directed to a cylinder liner of unusually simple design capable of achieving the same functional results which heretofore has required a considerably more complicated structure. Moreover, the disclosed design allows for desirable modifications in the cooling and lubrication systems of the internal combustion engine which were previously thought to be incompatible with the use of replaceable cylinder liners. In particular, the disclosed cylinder liner design permits a significant reduction in the total flow capacity and heat dissipating capacity of the engine cooling system. Moreover, the elimination of all contact between the lower portion of the liner and the engine block allows for a significant increase in the capacity of the oil return path from the valve train area back to the oil pan of the engine. These advantages are achieved by a cylinder liner design which permits a significantly simplified and yet improved seal between the liner and the engine block and between the liner and the engine head.

To understand the manner by which the various improvements noted above are achieved, reference is made to FIG. 1 in which an engine block 2 is illustrated in combination with a cylinder liner 4 constructed in accordance with the subject invention. Engine block 2 contains a cylinder cavity 6 extending between a surface 8 for engaging the engine head and a crank shaft receiving area 10. A piston 12, illustrated in dashed lines, is connected to the engine crank shaft by a connecting rod, both of which are not illustrated, to cause the piston to travel reciprocally within the liner between upper limit 14 (reached by the piston top) and lower limit 16 (reached by the piston bottom).

The engine block 2 is further provided with a liner stop 18 positioned intermediate the limits of travel 14, 16 of the piston. A mating stop engagement surface 20 is formed on the exterior of the cylinder liner 4 at an axial position arranged to cause the outer end of the cylinder liner to protrude slightly beyond the surface 8 of the engine block 2. For purposes of this description, the term "outer" will refer to a direction away from the crank shaft of the engine whereas the term "inner" will refer to a direction toward the engine crank shaft.

The outer end of the cylinder liner 4 is slightly enlarged, for reasons which will be explained in more detail hereinbelow, to provide a press fit with a mating cylindrical surface 22 formed on the interior of the cylinder cavity 6 adjacent the engine head engaging surface 8. Between surface 22 and stop 20 of the engine block, a coolant passage 24 is formed for providing a flow of coolant around the cylinder liner to thereby remove heat generated within the cylinder liner due to friction and fuel combustion. An annular recess 26 is formed in the outer surface of cylinder liner 4 in order to provide one wall of the coolant passage 24. As will be explained in more detail hereinbelow, the axial length of the coolant passage extends over no more than 30% of the total axial length of the liner. By this arrangement, stop 20 may be moved relatively high in the engine block relative to the engine head engaging surface 8 thereby providing additional room for return oil flow from the valve train area 28 into the lower portion 30 of the engine block as illustrated by arrow 32. To achieve this enlarged oil return flow path, the lower portion of liner 4 is free of all contact with the engine block along at least 30% of the inner most axial length of the liner.

Figure 2:
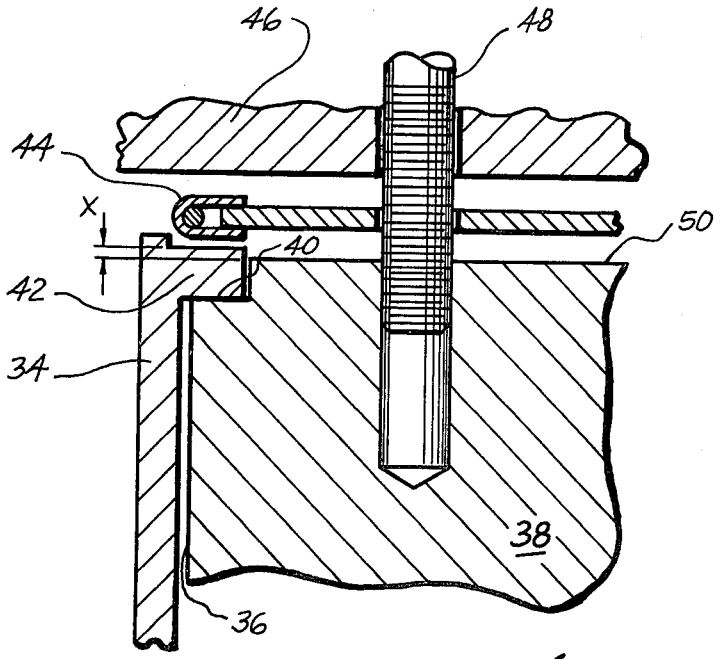
FIG. 2 (PRIOR ART)
FIG. 2 is a cutaway cross sectional view of a prior art engine block and cylinder liner having a top flange disposed between the engine block and head gasket.
Figure 3:
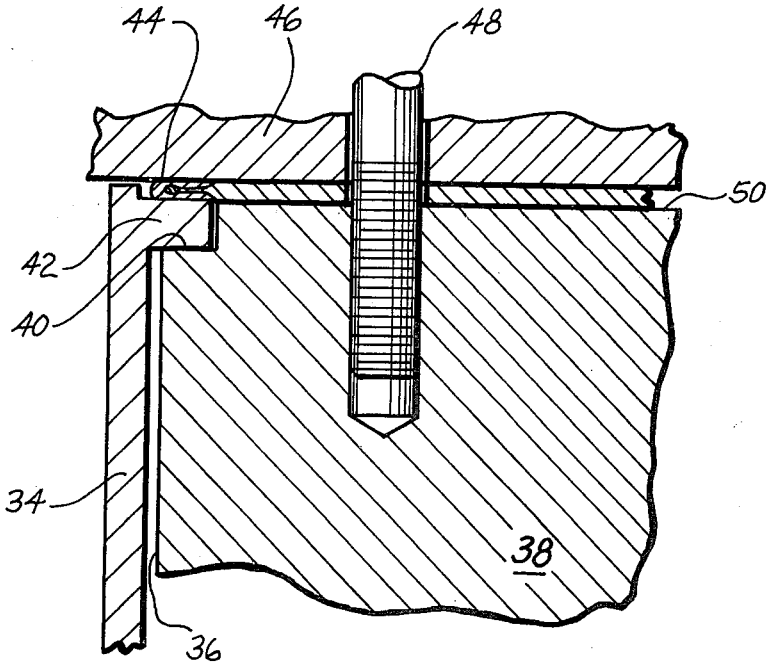
FIG. 3 (PRIOR ART)
FIG. 3 is a cutaway cross sectional view of the prior art engine block and cylinder liner illustrated in FIG. 2 wherein the top flange of the liner has been clamped between the engine block and head gasket.

To understand more clearly how the cylinder liner design of FIG. 1 is capable of optimizing the sometimes conflicting goals of low cost simplicity and high performance characteristics, reference will first be made to a prior art liner design as illustrated in FIGS. 2 and 3. In particular, FIG. 2 illustrates the cutaway top portion 34 of a conventional cylinder liner arranged to be placed within a cylinder cavity 36 contained in an engine block 38. The cylinder cavity 36 is counterbored at 40 to receive a top stop flange 42. The axial length of flange 42 exceeds the axial length of counterbore 40 by a predetermined amount X for the purpose of insuring concentrated compressive force between the block, the flange 42, the head gasket rim 44 and the engine head 46 when these elements are clamped together by the head bolts 48 (only one being illustrated in FIGS. 2 and 3). As is illustrated in FIG. 3, the tightening down of engine head 46 causes a deformation of the head gasket rim 44 to achieve the desired head gasket sealing pressure around the entire upper perimeter of the cylinder liner. The initial tightening of the head gasket as illustrated in FIG. 3 establishes a nominal liner load pressure on gasket rim 44. This gasket sealing pressure varies, however, during operation of the internal combustion engine due primarily to three separate factors which are: thermal expansion in the axial length of the top flange 44, gradual wear in the liner flange resulting in a slight decrease in the axial length of the flange, and combustion gas pressure within the cylinder which tends to reduce the compressive forces on the head gasket rim.

To understand the dynamics of head gasket seal pressure, it must also be recognized that manufacturing tolerances in the protrusion length X will cause variation in the nominal sealing pressure applied to head gasket rim 44 upon a given degree of torque being applied to head bolts 48.

Figure 4:
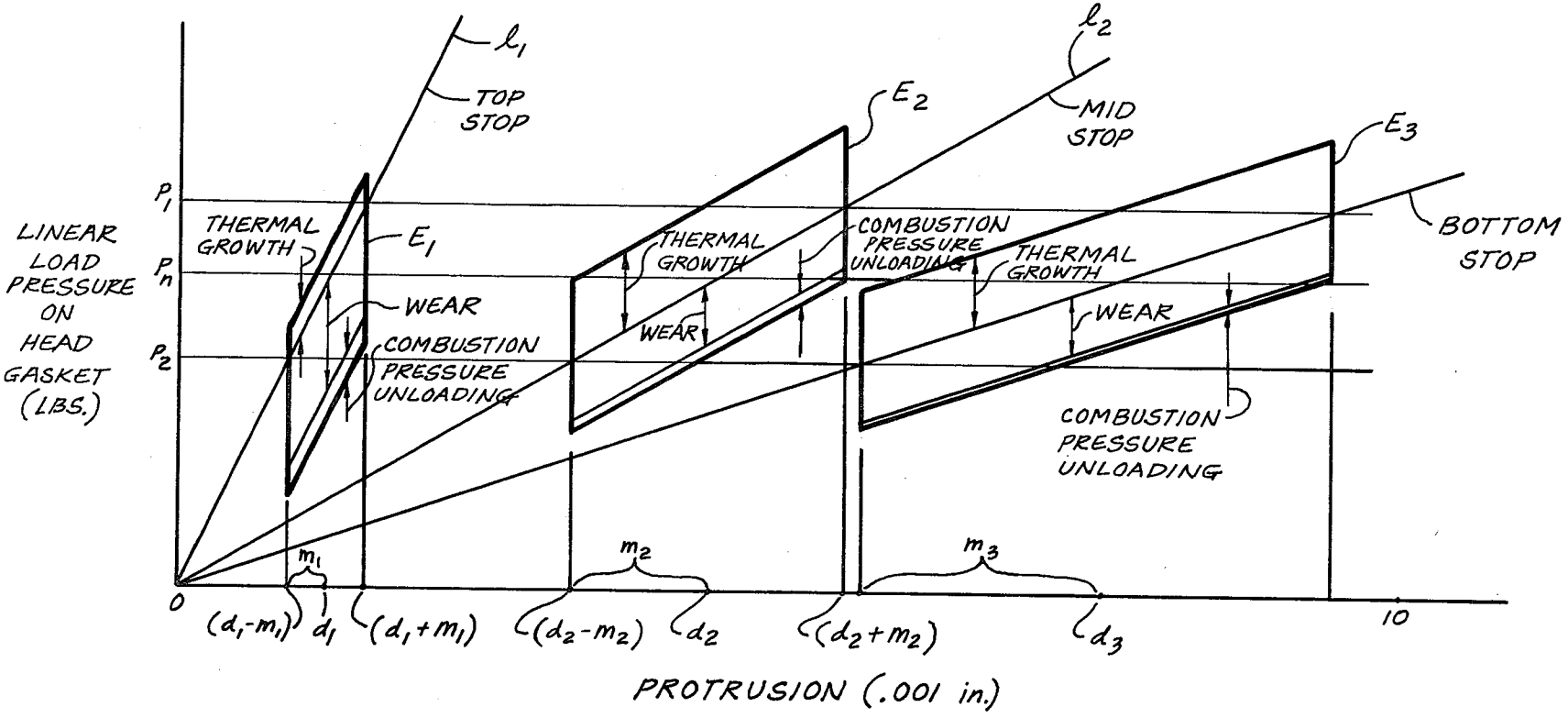
FIG. 4 is a graph illustrating the relationship betweeen liner protrusion above the head receiving surface of an engine block and the sealing pressure applied by the liner to the head gasket as determined by the axial position of the liner stop.

The various factors referred to above can perhaps best be understood by reference to FIG. 4 wherein a graph illustrates the relationship between liner protrusion above the head engaging surface of an engine block versus the pressure applied to the head gasket rim by the liner as a result of a given head bolt torque. In particular, $p_H$ represents the nominal pressure which it is desired to place on the head gasket rim while $p_1$ and $p_2$ represent upper and lower nominal pressures which may be accepted as a result of variations in the protrusion of the liner above the head engaging surface of the block due to manufacturing tolerances. When the cylinder liner is of the top stop type, as illustrated in FIGS. 2 and 3, the top stop flange is fairly incompressible. Thus, a small manufacturing tolerance will result in a greater variation in the nominal seal pressure as is represented by line $l_1$. Assuming that $p_1$ and $p_2$ define the acceptable nominal variation limits in initial gasket sealing pressure, the amount of manufacturing tolerance permitted in the nominal protrusion $d_1$ would be a distance indicated by $m_1$ along the horizontal axis illustrated in FIG. 4. However, as mentioned above, certain dynamic considerations must also be considered as illustrated by the envelope $E_1$ of FIG. 4, wherein the relative effects of thermal growth, wear and combustion pressure unloading as defined above are illustrated by the respectively labeled arrows. Envelope $E_1$ thus defines the extreme upper and lower pressures which will be applied to the head gasket rim by a liner having a top stop flange nominally protruding above the head engaging surface of the engine block by an amount between $(d_1-m_1)$ and $(d_1+m_1)$. Prior experience with liners of this type has shown that it is difficult to maintain tolerances within the required range. Should the protrusion tolerances be exceeded, seal failure may result or the engine block may be cracked in the area of the counterbore.

Envelope $E_2$ graphically illustrates the dynamic seal pressures applied to a cylinder liner having a flange stop located intermediate (mid stop) the axial length of the liner. As would be expected, the thermal growth of the liner between the stop and the head gasket rim becomes a much greater factor, while the wear factor remains relatively constant and the combustion pressure unloading factor is reduced. However, the greater compressibility of a liner having a mid stop results in a different linear relationship between the protrusion length and the nominal pressure applied to the head gasket rim upon initial assembly and torquing of the head gasket bolts. This changed linear relationship is illustrated by line $l_2$ in FIG. 4. Due to this changed relationship, the amount of permissible manufacturing tolerance in the protrusion of the liner above the head engaging surface of the block can be much greater with a mid stop liner than with a top stop liner as is evident from a comparison of the acceptable protrusion variation $m_2$ of a mid stop liner versus the smaller variation $m_1$ permitted with a top stop liner. Significant manufacturing costs savings can be realized when greater tolerances are permitted. FIG. 4 also discloses envelope $E_3$ representative of the dynamic sealing pressures applied to the rim of a head gasket by a liner provided with a bottom stop. The permissible tolerance in liner protrusion $m_3$ permitted with such a bottom stop liner is greater than with either a mid stop or top stop liner.

For reasons which will be explained hereinbelow, other design considerations make the use of a bottom stop liner less desirable than the mid stop liner. After very careful analysis, it has been discovered that only the upper portion of a cylinder liner need be subjected to coolant flow in order to maintain temperatures along the entire length of the liner within acceptable limits dictated by materials of which the engine is formed. In particular, it has been discovered that the axial length of the annular recess 26, FIG. 1, need be no more than 30 percent of the total axial length of the liner so long as this coolant flow is provided near the outer end of the liner. By so limiting the amount of liner surface actually exposed directly to coolant flow, the total coolant flow capacity of the engine cooling system may be reduced. Reduction in the size and capacity of the cooling system can have a significant effect in reducing the initial installation cost of an engine. Moreover, by limiting the coolant flow to the upper portion of the cylinder liner, it is possible to dispose the liner within the engine block in such a way that the lower or inner 40 percent of the liner is free of all contact with the engine block. By this arrangement, yet another significant advantage is achieved in that the return oil passages through the engine block may be significantly widened over conventional design thereby eliminating the possibility of inadequate lubrication flow through the engine.

Figure 5:
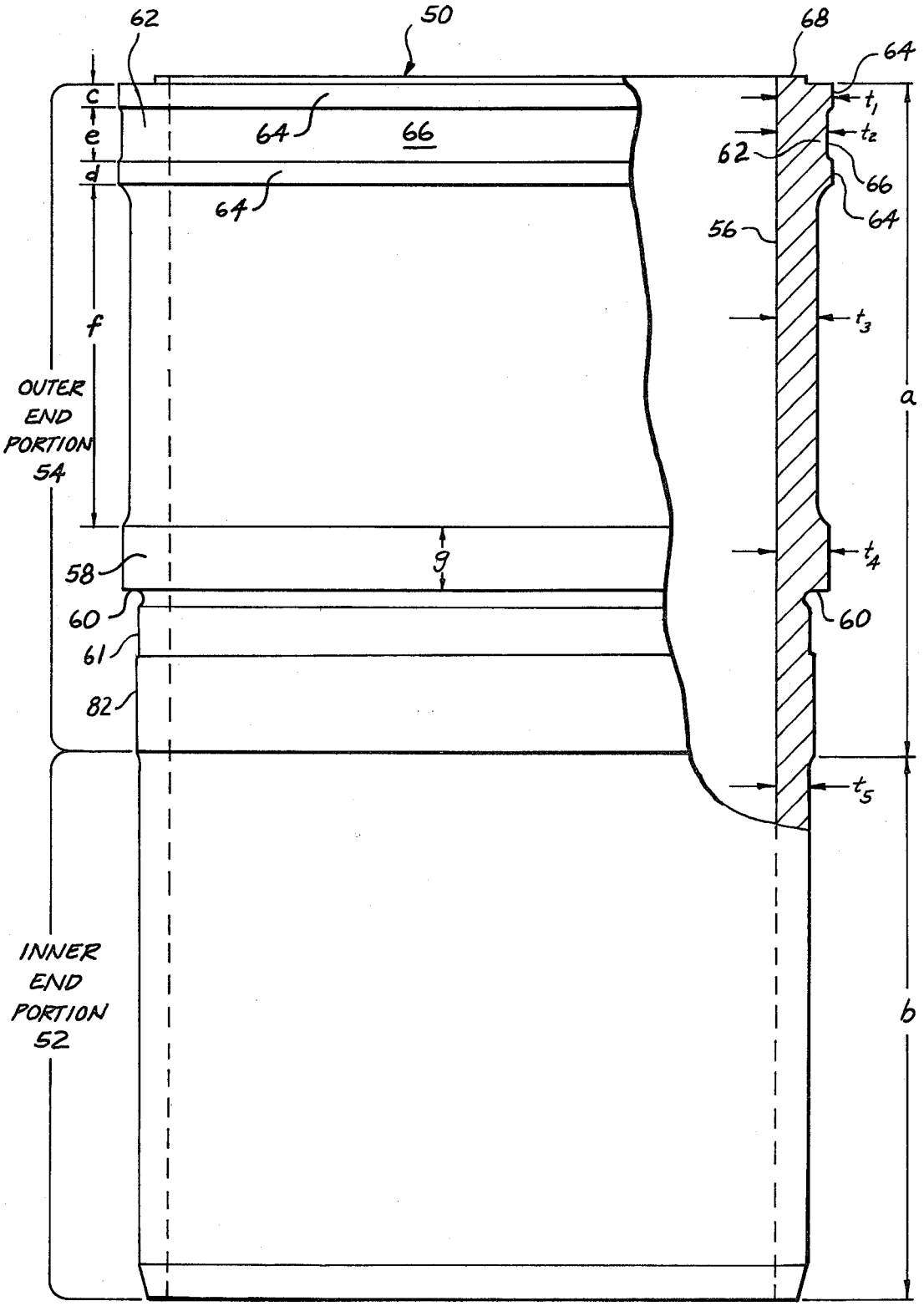
FIG. 5 is a cutaway side elevational view of a cylinder liner constructed in accordance with the subject invention.
Figure 6:
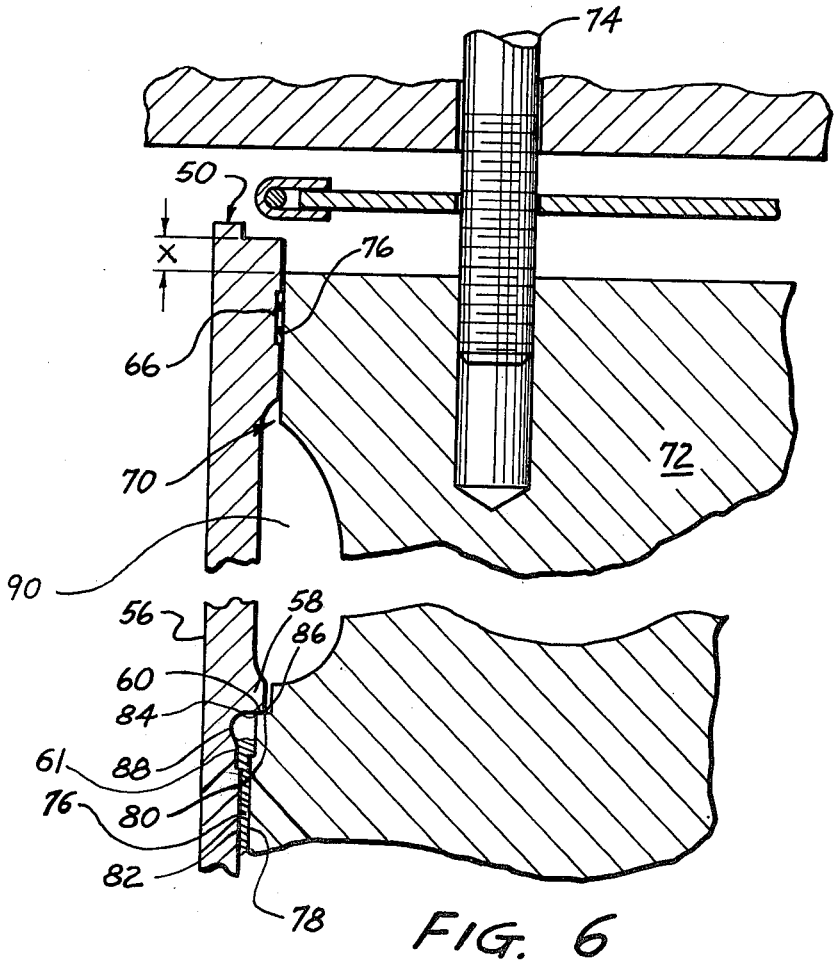
FIG. 6 is a cutaway cross sectional view of the liner illustrated in FIGS. 1 and 5 prior to being placed under compression by the engine cylinder head.

It has been discovered that the liner design of FIG. 1, illustrated in greater detail in FIG. 5, provides an optimization of the various design considerations noted above. In particular the liner of FIG. 5 includes a hollow cylindrical body 50 having an inner end portion 52 and an outer end portion 54. A cylindrical piston engaging inside surface 56 extends the entire axial length of the hollow cylindrical body 50 as illustrated in FIG. 5. Near the inner (lower) section of outer end portion 54 is a stop boss 58 formed on the outer surface of end portion 54 and including a stop engaging surface 60 for engaging the liner stop 18 formed in the cylinder cavity 6 of the engine block, FIG. 1. As will be explained hereinbelow, the configuration of this stop boss and the adjacent portions of the liner's outer surface have been found to be extremely important to the satisfactory operation of the subject liner. In particular, a cylindrical recess 61 is formed in the outer surface of the liner inwardly of stop engaging surface 60. Cylindrical recess 61 is designed to receive a settable plastic material which remains plastic during press fitting of the liner into the cylinder cavity. When the material subsequently sets, it forms an extremely rigid spacer between the liner and block to provide radial support to the liner. One suitable type of material is sold under the trademark LOCTITE by Loctite Corporation, 705 North Mountain Road, Newington, Conn. While in a plastic state, the settable material provides no resistance to the press fitting of a cylinder liner within an engine block. Subsequent setting of the material, however, results in the provision of an extremely rigid support between the liner and the engine block along the entire axial length of annular seal surface 82 (FIG. 6).

At the outermost end of the end portion 54 of the liner, an end boss 62 is formed on the outer surface for providing a reinforcing and securing means primarily for frictionally engaging the inside surface of the cylinder cavity 6 to form a coolant seal and for resisting the deforming forces resulting from fuel combustion within the hollow cylindrical body. In particular, extremely high combustion pressures tend to occur adjacent the upper limit of piston travel since, of course, the greatest compression of the fuel/air charge occur at this point as does the ignition of the charge which adds further to the gas pressures. To avoid the necessity of providing an extremely thick outer rim on the liner, it is necessary to rely upon the engine block to provide resistance to radial expansion of the cylinder liner adjacent the outermost end of the liner. It is also desirable to avoid radial movement of the outer end of the liner to avoid relative movement between the liner and the head gasket rim which seals the upper end of the piston cylinder.

In addition to the above considerations, it is essential that the cylinder liner be very accurately positioned within the cylinder cavity at at least one point along the axial length of the liner. This result is normally achieved by making one portion of the liner slightly larger than a corresponding portion of the cylindrical cavity to thereby cause the liner to be press fitted within the cavity and force the liner into a precisely desired position. While such a press fit is often provided adjacent the liner stop, it has been discovered that provision of a press fit below the mid point stop formed by stop boss 58 results in an unacceptable distortion of the cylindrical surface 56, thereby significantly decreasing the life of the piston rings. Accordingly, the press fit surface has been formed on the exterior of the end boss 62. Careful analysis of the axial length over which the press fit should occur to provide optimum press fit characteristics has resulted in the conclusion that the axial length of the press fit should occur over an axial length significantly less than the axial length over which it would be desirable for the engine block to be used as a radial deformation restraint on the upper end of the liner. Stated in another way, it has been determined that the amount of engine block restraint on the radial expansion of the upper end of a cylinder liner, due to the occurrence of combustion gas pressures at that point, should be significantly greater than the optimum axial length over which a press fit can occur without causing excessive installation and/or removal forces.

This apparent inconsistency has been solved as illustrated in FIG. 5 by providing end boss 62 with a pair of annular, axially spaced cylindrical surfaces wherein the outside diameters of these surfaces are greater than any other portion of the hollow cylindrical body 50 and are slightly greater than the inside diameter of the corresponding surface 22 of the cylinder cavity 6. To facilitate assembly of the liner within an engine block of the type illustrated in FIG. 1, the outside diameter of stop boss 58 is slightly less than the diameter of surfaces 22, thereby allowing the stop boss 58 to clear this portion of the cylinder cavity. Separating annular surfaces 64 is a circular recess 66 having a depth sufficient to clear surface 22 of the cylinder cavity 6. Circular recess 66 is arranged to form a retaining means for settable plastic material, such as LOCTITE, designed to remain plastic during the press fitting of the liner into the cylinder cavity. This material subsequently sets to provide a coolant seal and secondarily to provide a radial support to the outer end portion of the liner adjacent surface 22. As illustrated in FIG. 5, the axial length e of circular recess 66 is equal to approximately $1\frac{1}{2}$ times the sum of the axial lengths (c+d) of the annular axially spaced cylindrical surfaces 64.

A combustion gas deflecting lip 68 is provided on the outer axial end surface of end portion 54 for the purpose of deflecting combustion gases away from the rim of the head gasket which contacts the cylinder liner. It should be noted, however, that the axial length of the lip 68 is less than the compressed length of the liner gasket and is, therefore, never brought into contact with the engine head.

For purposes of illustration, the relative sizes of the various liner sections illustrated in FIG. 5 are listed below in chart form in millimeters.

DIMENSIONAL CHART

| Size Designation | Dimension (mm) |
|---|---|
| a | 132 |
| b | 108 |
| c | 4 |
| d | 4 |
| e | 12 |
| f | 68 |
| g | 12 |
| $t_1$ | 10.49 |
| $t_2$ | 9.49 |
| $t_3$ | 7.49 |
| $t_4$ | 9.99 |
| $t_5$ | 6.24 |

Referring now to FIG. 6, the liner body 50 of FIG. 5 is illustrated in a press fitted but uncompressed position within a cylinder cavity 70 of an engine block 72 prior to the final torquing of the head bolts 74. Before being press fitted, a settable but plastic material 76, such as LOCTITE, is deposited on annular seal surface 82 and within recess 66 in order to provide the radial support described above without interferring with the press fitting characteristics of the liner. As illustrated in FIG. 6, an annular sealing wall 78 is provided interiorly of the liner stop 80 corresponding to the liner stop 18 of FIG. 1. A corresponding annular seal surface 82 is provided inwardly of recess 61 on the exterior of liner body 50 below stop boss 58. The outside diameter of surface 82 is such as to provide a clearance with sealing wall 78 thereby to prevent engagement during the press fitting of liner 50 within the cylinder cavity 70. The provision of a clearance at this point has been found to be desirable as long as the stop engaging surface 60 and the liner stop 80 are shaped to insure that the point of contact between these surfaces will occur along the extreme inner tip 84 of the liner stop. The way in which this is assured will be discussed in greater detail hereinbelow. The least deflection in the piston guiding surface 56 occurs under these circumstances. Alternatively, the surface 60 and stop 80 may be shaped to cause the line of contact to always occur at the outside edge 86 of surface 60, in which case surfaces 78 and 82 should be dimensioned to provide an interference fit in order to minimize the amount of distortion which occurs during the assembly and compression of the liner within an engine block.

When a clearance space is provided between surfaces 78 and 82, a settable plastic material such as LOCTITE is placed within recess 61 to provide, when hardened, additional radial support and a backup seal to that formed between surface 60 and liner stop 80. To prevent excessive fluid pressure build up due to an overflow of settable plastic material, a second deeper annular seal recess 88 may be provided to receive the excess plastic material during initial insertion of the liner into cavity 70. Recess 88 may alternatively be used for a compliant seal to provide further insurance against the leakage of coolant from coolant passage 90.

Figure 7:
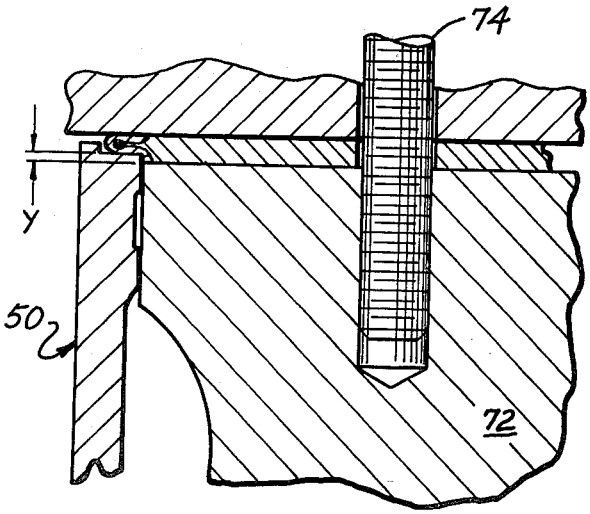
FIG. 7 is a cutaway cross sectional view of the cylinder liner illustrated in FIG. 6 after being compressed by the cylinder head through the head gasket.

FIG. 7 discloses the relationship of the various elements illustrated in FIG. 6 upon the head bolts 74 being torqued. It should be noted that the protrusion length X of FIG. 6 has been considerably reduced to Y due to the resilient compliance of the liner between its outermost end and the stop engaging surface 60. Of course distances X and Y have been greatly exaggerated. A typical value for X would be 0.006±0.002 inches. When compressed in the manner illustrated in FIG. 7, surfaces 60 and 80 will form a coolant tight seal. As no relative movement occurs between these surfaces during thermal cycling of the liner, the possibilities of seal deterioration is greatly lessened.

Figure 8:
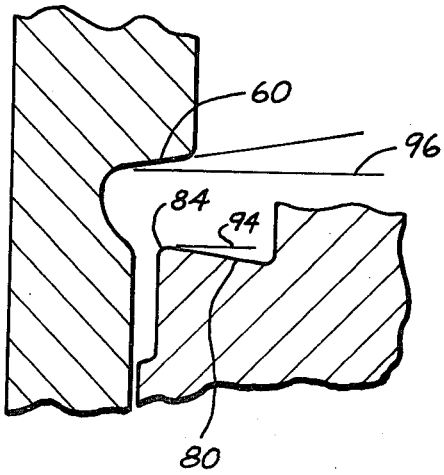
FIG. 8 is an enlarged cutaway cross sectional view of the engine block liner stop and mating stop engaging surface formed on the cylinder liner of FIG. 6.

Referring now to FIG. 8, the manner by which contact is assured between surface 60 and stop 80 along the innermost edge 84 of stop 80 is illustrated. In particular the outer surface of stop 80 is formed with a manufacturing tolerance held within limits defined by a plane 94 passing perpendicularly through the central axis of the cylinder cavity 70 and a truncated cone having its axis coincident with the central axis of the cylinder cavity 70 and its apex oriented toward the outer end of the cavity 70. Surface 60, on the other hand, is formed with a manufacturing tolerance held between limits defined by a plane 96 passing perpendicularly through the central axis of the liner and by a truncated cone having a central axis coincident with the central axis of the liner and having an apex pointed toward the inner end of the liner.

It is now apparent that a cylinder liner has been disclosed and described above which combines in a single simplistic design several functional advantages which heretofore has required significantly more complicated and, therefore, costly designs.

We claim:

1. A liner for a cylinder cavity within the block of an internal combustion engine having a liner stop positioned within the cylinder cavity at a point intermediate the extremes of travel of a piston disposed for reciprocating travel within the cylinder cavity, and having an annular sealing wall extending interiorly of the engine block starting at the liner stop, comprising (a) a hollow cylindrical body having an inner end portion and an outer end portion;

(b) reinforcing and securing means for resisting the deforming forces resulting from fuel combustion within said outer end portion and for compressively and frictionally engaging the inside surface of the cylinder cavity when pressed thereinto, said reinforcing and securing means including (1) an end boss adjacent the outer end of said outer end portion, (2) a pair of annular, axially spaced cylindrical surfaces formed on the outside of said end boss having outside diameters greater than any other portion of said hollow cylindrical body and slightly greater than the inside diameter of corresponding portions of the cylinder cavity into which said hollow cylindrical body is designed to be press fitted, and (3) settable plastic material retaining means separating said annular axially spaced cylindrical surfaces for receiving material which remains plastic during a press fitting of said hollow cylindrical body into the cylinder cavity and which is subsequently settable to provide radial support to said hollow cylindrical body over the axial distance between said cylindrical surfaces, said settable material retaining means including circular recess contained within said end boss located between said cylindrical surfaces; and (c) a stop means for positioning said hollow cylindrical body within the cylinder cavity, said stop means including a stop boss formed on the outer surface of said hollow cylindrical body within the cylinder cavity, said stop means including a stop boss formed on the outer surface of said hollow cylindrical body intermediate its ends, said stop boss including a stop engaging surface for engaging the engine block liner stop, said stop engaging surface being positioned to cause said outer end portion of said hollow cylindrical body to extend a predetermined distance beyond the outer extreme of the cylinder cavity when said stop engaging surface is placed in contact with the engine block liner stop, said stop boss has an outside diameter which is less than the inside diameter of that portion of the cylinder cavity with which said annular axially spaced cylindrical surfaces are designed to be frictionally engaged, whereby said stop boss is able to clear that portion of the cylinder cavity which is frictionally engaged by said annular, axially spaced cylindrical surfaces when said hollow cylindrical body is assembled in the engine block, wherein said hollow cylindrical body includes an annular recess formed in the outside surface of said hollow cylindrical body between said end boss and said stop boss to form one wall of a coolant passage for removing heat from the liner, said inner end portion of said hollow cylindrical body includes a skirt portion integrally joined to said outer end portion at one end, said skirt portion being designed for use while being free of any direct contact with the engine block when inserted therein, said hollow cylindrical body includes an annular sealing means for retaining a settable plastic material between the liner and the annular sealing wall of the engine block to form a secondary coolant seal inwardly of said stop boss and to provide radial support to said hollow cylindrical body without interfering with the press fitting of said end boss, said annular sealing means including an annular seal surface arranged to be positioned adjacent to but a predetermined distance from the annular sealing wall of the engine block to form a clearance space, and wherein said annular sealing means includes a cylindrical recess between said stop engaging surface and said annular seal surface for retaining settable plastic material and a second deeper annular seal recess between said stop engaging surface and said cylindrical recess for receiving a compliant annular seal and for receiving excess settable plastic sealant pressed out of the clearance space between said annular seal surface and the annular sealing wall when the liner is press fitted into an engine block.

2. A replaceable liner for use in an internal combustion engine containing a liner receiving cavity extending between the engine head and a crankshaft to which a piston is connected for reciprocating travel within the liner receiving cavity and having a liner stop positioned intermediate the ends of the liner receiving cavity and a liner coolant passage formed to provide coolant to the outer surface of the liner, comprising (a) a substantially cylindrical outer end portion having a piston engaging inside surface for guiding the piston during one portion of reciprocating piston travel leading to and from the outer limit of piston travel and a top end face for forming a combustion gas seal with the engine head, said cylindrical outer end portion including (1) securing means for preventing radial movement of said outer end portion while permitting limited axial movement of the outer end portion within the liner receiving cavity by forming a radial press fit with the inside surface of the liner receiving cavity by compressively and frictionally engaging the inside surface of the liner receiving cavity when pressed thereinto, said securing means including an end boss adjacent the outermost end of said cylindrical outer end portion, said end boss having an outside cylindrical surface extending inwardly from said top end face, said outside cylindrical surface having a diameter slightly greater than the inside diameter of the liner receiving cavity adjacent said end boss to form a coolant impervious press fit completely around said end boss between the inside surface of the liner receiving cavity and the liner when the liner is placed within the liner receiving cavity, said end boss being free of any engine engaging radial surface thereby permitting axial movement of the outermost end of said outer end portion within the liner receiving cavity, (2) stop means for retaining the innermost end of said outer end portion against axially inward movement relative to the liner receiving cavity, said stop means including a stop boss adjacent the innermost end of said outer end portion, said stop boss including a radially oriented stop engaging surface continuously engaging the liner stop when said liner is placed within the liner receiving cavity to form a substantially coolant impervious seal when the liner is biased with sufficient force against the liner stop, and (3) an annular recess formed in the outside surface of said cylindrical outer portion and extending over substantially the entire axial distance between said end boss and said stop boss to form one wall of the liner coolant passage when the liner is placed within the engine, said annular recess extending over no more than approximately 30% of the total axial length of the liner; and (b) a cylindrical inner end portion integrally joined with said outer end portion, said inner end portion having a piston engaging inside surface which is a continuation of said piston engaging inside surface of said outer end portion for guiding piston movement during the remaining portion of the reciprocal piston movement, said inner end portion being free of direct supporting and heat conducting contact between said inner end portion and the inside surface of the liner receiving cavity, said inner end portion having an axial length equal to at least 30 percent of the total length of said inner and outer end portions.

3. A replaceable liner for use in an internal combustion engine including a head and a block having a head engaging surface and a liner receiving cavity extending between the head engaging surface and a crankshaft to which a piston is connected for reciprocating travel within the liner and having a liner stop positioned approximately in the midsection of the liner receiving cavity and a liner coolant passage formed to provide coolant to the outer surface of the liner, comprising:

(a) a hollow cylindrical body formed of material having predetermined resilient characteristics including an outer end portion having a piston engaging inside surface for guiding piston movement to and from the outer limits of piston travel and a top end face for forming a combustion gas seal with the engine head and including an inner end portion having a piston engaging inside surface which is a continuation of said piston engaging inside surface of said outer end portion for guiding piston movement during the remaining portion of the reciprocal piston movement, said inner end portion being free of direct supporting and heat conducting contact between said inner end portion and the engine block, said inner end portion having an axial length equal to at least 30 percent of the total length of said inner and outer end portions; and (b) positioning means utilizing the resilient characteristics along the entire axial length of said outer end portion to maintain an adequate combustion gas seal between said top end face and the engine head, said positioning means including (1) securing means for preventing radial movement of said outer end portion while permitting limited axial movement of the outer end portion within the cylindrical cavity by forming a radial press fit with the inside surface of the liner receiving cavity by compressively and frictionally engaging the inside surface of the liner receiving cavity when pressed thereinto, said securing means including an end boss adjacent the outermost end of said outer end portion, said end boss having an outside cylindrical surface extending axially inwardly from said top end face, said outside cylindrical surface having a diameter slightly greater than the inside diameter of the liner receiving cavity adjacent the head engaging surface to form a coolant impervious press fit completely around said end boss between the engine block and the liner when the liner is placed within the liner receiving cavity, said end boss being free of any block engaging radial surfaces thereby permitting axial movement of the outermost end of said outer end portion within the liner receiving cavity, and (2) stop means for retaining the innermost end of said outer end portion against axially inward movement relative to the liner receiving cavity, said stop means including a stop boss adjacent the innermost end of said outer end portion, said stop boss including an outside diameter smaller than the outside diameter of said end boss, said stop boss including a radially oriented stop engaging surface continuously engaging the liner stop when said liner is placed within the liner receiving cavity to form a substantially coolant impervious seal when the liner is biased with sufficient force against the liner stop, said stop engaging surface being positioned to cause said outer end portion to extend a predetermined distance beyond the head engaging surface of the engine block when said stop engaging surface is placed in contact with the liner stop; and wherein said outer end portion contains an annular recess formed in the outside surface of said outer portion and extending over substantially the entire axial distance between said end boss and said stop boss to form one wall of the liner coolant passage when the liner is placed within the engine block, said annular recess extending over no more than approximately 30% of the total axial length of the liner.

4. A liner as defined in claim 3, for use in an engine block having an annular sealing wall extending interiorly of the engine block starting at the liner stop, wherein said outer end portion includes an annular sealing means for retaining a settable plastic material between the liner and the annular sealing wall of the engine block to form a secondary coolant seal inwardly of said stop boss and to provide radial support to said liner without interferring with the press fitting of said end boss, said annular sealing means including an annular seal surface arranged to be positioned adjacent to but at a predetermined distance from the annular sealing wall of the engine block to form a clearance space.

5. A liner as defined in claim 4, wherein said annular sealing means includes a cylindrical recess between said stop engaging surface and said annular seal surface for retaining settable plastic material and a second deeper annular seal recess between said stop engaging surface and said cylindrical recess for receiving a compliant annular seal or for receiving excess settable plastic sealant pressed out of the clearance space between said annular seal surface and the annular sealing wall when the liner is press fitted into an engine block.

6. A liner as defined in claim 3, for use with an engine block liner stop formed as a uninterrupted lip extending 360° around the inside surface of the liner receiving cavity with the liner contacting surface of the liner stop being formed with a manufacturing tolerance held within limits defined by a plane passing perpendicularly through the central axis of the cylinder cavity and a truncated cone having its axis coincident with the central axis of the cylinder cavity and its apex oriented toward the outer end of the liner receiving cavity, wherein said stop engaging surface is formed with a manufacturing tolerance held within limits which insures that contact between the stop engaging surface and the liner stop takes place along a line of contact as close to said outer end portion as possible, said tolerance limits of said stop engaging surface being defined by a plane passing perpendicularly through the central axis of said outer end portion and by a truncated cone having a central axis coincident with the central axis of said outer end portion and having an apex pointed toward said inner end portion.

7. A liner as defined in claim 6 for use with an engine block liner stop being formed of slightly compliant, resilient material, wherein said stop boss is formed of material which is slightly compliant whereby a coolant tight seal may be formed between said stop engaging surface and the engine block liner stop upon application of compressive force sufficient to overcome shape imperfections due to manufacturing tolerance by deforming the engine block liner stop.

8. A replaceable liner as defined in claim 3, wherein said end boss includes (a) a second cylindrical surface axially spaced from said previously mentioned cylindrical surface formed on the outside of said end boss, said cylindrical surfaces having outside diameters greater than any other portion of said liner and slightly greater than the inside diameter of corresponding portions of the liner receiving cavity into which said liner is designed to be press filled, and (b) settable plastic material retaining means separating said axially spaced cylindrical surfaces for receiving material which remains plastic during a press fitting of said hollow cylindrical body into the liner receiving cavity but which is subsequently settable to provide radial support to said hollow cylindrical body over the axial distance between said cylindrical surfaces, said settable material retaining means including a circular recess contained within said end boss located between said cylindrical surfaces.

9. A liner as defined in claim 8, wherein said stop boss has an outside diameter which is less than the inside diameter of that portion of the liner receiving cavity with which said axially spaced cylindrical surfaces are designed to be frictionally engaged whereby said stop boss is able to clear that portion of the liner receiving cavity which is frictionally engaged by said axially spaced cylindrical surfaces when the liner is assembled in the engine block.

10. A liner as defined in claim 8, wherein the total axial length of said cylindrical surfaces is equal to no more than 50 percent of the total axial length of said end boss.

* * * * *